US005466164A

United States Patent [19]

Miyazaki et al.

[11] Patent Number: 5,466,164

[45] Date of Patent: Nov. 14, 1995

[54] CONNECTOR HAVING A PROTECTIVE HOOD

[75] Inventors: Sho Miyazaki; Hisashi Konoya; Yoshihiro Tanaka; Mitsuhiro Fujitani; Kazumoto Konda, all of Yokkaichi, Japan

[73] Assignee: Sumitomo Wiring Systems, Ltd., Japan

[21] Appl. No.: 207,360

[22] Filed: Mar. 7, 1994

[30] Foreign Application Priority Data

Mar. 9, 1993 [JP] Japan ..... 5-076134
Mar. 31, 1993 [JP] Japan ..... 5-098556

[51] Int. Cl.[6] ..... H01R 13/453

[52] U.S. Cl. ..... 439/140; 439/141

[58] Field of Search ..... 439/140, 141

[56] References Cited

U.S. PATENT DOCUMENTS 3,747,047 7/1973 Carter ..... 439/141
4,109,989 8/1978 Snyder, Jr. et al. ..... 439/140
5,167,516 12/1992 Tan et al. ..... 439/140

FOREIGN PATENT DOCUMENTS 209479 7/1992 Japan .
124774 11/1992 Japan .
136882 12/1992 Japan .

*Primary Examiner*—Neil Abrams
*Attorney, Agent, or Firm*—Jordan B. Bierman; Bierman and Muserlian

[57] ABSTRACT

This invention provides a connector which can positively effect coupling and detaching of a female connector, prevent electric shock and short-circuiting, and prevent an electric failure arising from contamination by extraneous substances. A lid plate 15 is biased by a compression coil spring 22 so that the lid plate is held by limit projections 26 at a protection position for covering male terminals 12 when a female connector is not coupled to the connector. Even if the lid plate 15 is pushed down by an external force so that the male terminals 12 are exposed from the lid plate 15, it can return to the protection position by itself when the external force is released. Since the lid plate 15 is constrained from rotating circumferentially at the protection position, the male terminal 12 smoothly passes through a terminal-through hole 16 in the lid plate 15 when the female connector 40 is inserted into a hood 13 and then the male terminals 12 are connected to female terminals 43. When the female connector 40 is extracted from the hood 13, the lid plate 15 is moved to the protection position by a bias of the compression coil spring 22. The terminal-through holes 16 in the lid plate 15 are closed by deformable tongue pieces of a dust-proofing rubber plate 150 to prevent the entrance of dust, water, or the like.

10 Claims, 14 Drawing Sheets

CONNECTOR HAVING A PROTECTIVE HOOD

BACKGROUND OF THE INVENTION

1. Field of the Invention

This invention relates to a connector in which electrical safety is enhanced and more particularly to a connector suitable for charging a storage battery in an electric automobile.

2. Statement of the Prior Art

Recently, electric automobiles having a storage battery or batteries have been attracting attention in view of protection of the environment and energy conservation and some of them have been put to practical use. In such an electric automobile, it is necessary to be able to readily interconnect the storage battery and a charger since the storage battery must be charged. Thus, heretofore, a connector has been generally utilized to interconnect them. An example of such a connector will be explained below.

A car side connector connected to a battery is secured to a car body while a charger side connector is connected to an end of a flexible cable drawn out of a charger. The car side connector has a plurality of male terminals exposed in its hood while the charger side connector has a plurality of female terminals disposed in its housing to receive the male terminals. The charger side connector is formed into a shape adapted to be received in the hood of the car side connector. When the charger side connector is inserted into the hood, the terminals are electrically coupled with each other.

However, since the male terminals are exposed in the hood, they may be accidentally touched thus causing electric shock or be contaminated with extraneous substances resulting in electrical failure.

In order to enhance electrical safety, for example, Japanese Utility Model Public Disclosure No. 4-124774 (1992) discloses a connector in which a lid is attached through a hinge to the hood of the connector so that the lid can close and release an opening in the hood.

However, since the lid must be opened by one hand to expose the male terminals and a female connector then be inserted into the hood of the connector with another hand, this construction requires a two-handed two step operation, and is therefore inefficient.

Further, in order to overcome such problems, Japanese Patent Public Disclosure No. 4-209479 (1992) discloses a connector wherein an insulation plate is movably mounted in a hood, the insulation plate is provided with through holes through which male terminals pass, a female connector is coupled to a male connector while pushing the insulation plate, the female connector and the insulation plate are detached from the male connector with the female connector accompanying the insulation plate, the female connector is disengaged from the insulation plate and the insulation plate is maintained in its position when the insulation plate moves to the distal ends of the male terminals.

However, in the above connector, since the insulation plate must guide the male terminals to couple them to the female terminals, the male terminals must pass through the insulation plate and expose their distal ends. Accordingly, this construction can not enhance electrical safety.

In order to enhance electrical safety, the insulation plate must be disengaged from the male terminals and move to a position covering the male terminals. However, even if the insulation plate merely moves over the distal ends of the male terminals, the through holes shift from the male terminals when the insulation plate is detached from the male terminals. Under this condition, when a female connector is inserted into the male connector, the insulation plate abuts on the distal ends of the male terminals, thereby causing the female connector to be hardly inserted into the male connector.

In addition, in the above connector, even if the insulation plate is engaged with the distal ends of the male terminals, the insulation plate is pushed to an inner part of the hood by any external force to expose the male terminals in their entirety.

SUMMARY OF THE INVENTION

A first object of the present invention is to provide a connector to which a mating connector can be readily connected and by which electrical safety can be enhanced.

A second object of the present invention is to provide a connector which can positively prevent any accidental touching of the terminals or entering of extraneous substances.

In order to achieve the above first object, in a connector of the present invention, a plurality of male terminals are provided on the interior of a hood adapted to receive a female connector having a plurality of female terminals. The connector comprises: a lid plate provided with a plurality of terminal-through holes through each of which said male terminal can pass and received in said hood movably in the inserting and detaching directions; means for biasing said lid plate to a protection position in which said lid plate covers an opening in said hood; means for constraining said lid from falling off said hood; and means for positioning said lid plate when it is disposed at the protection position in the hood so that said terminal-through holes confront male terminals.

When the mating connector is not inserted into the hood of the connector, the lid plate is maintained at the protection position by the biasing means and constraining means so that the lid plate covers the male terminals at the open end of the hood, thereby preventing the fingers or extraneous substances from contacting with the male terminals. Even if an external force is temporarily applied to the lid plate so that the lid plate is pushed into an inner part of the hood, the lid plate can be returned to the protection position by the biasing means to cover the male terminal.

On the other hand, when the mating connector is inserted into the hood, the mating connector pushes the lid plate into the inner part of the hood, the male terminals pass through the terminal-through holes in the lid plate, and the male terminals are connected to the mating terminals. At this time, since the lid plate at the protection position is constrained from falling off and rotating in the hood by the positioning means, the male terminals are positively inserted into the terminal-through holes and the lid plate can be smoothly pushed into the inner part of the hood.

When the female connector is drawn out of the hood, the lid plate is automatically advanced to the protection position by the biasing means in connection with the movement of the female connector.

Thus, it is possible in the present invention to effect the connecting and detaching of the mating connector to and from the hood by a very simple operation. When the mating connector is drawn out of the hood, the male terminals are covered by the lid plate at the open end of the hood, thereby enhancing the electrical safety.

In order to achieve the above second object, the connector of the present invention further comprises a flexible member attached to the rear side of said lid plate for deformably covering said terminal-through hole.

When the mating connector is not inserted into the hood of the connector, the lid plate is maintained at the protection position by the biasing means and constraining means so that the lid plate covers the male terminals at the open end of the hood, thereby preventing the fingers or extraneous substances from contacting with the male terminals. Under this position, the male terminals pass through the terminal-through holes. However, since the terminal-through holes are closed by the resilient or deformable tongue pieces or members having many fibers, fine substances such as dusts can not enter into the interior of the hood through the holes.

On the other hand, when the mating connector is inserted into the hood., the mating connector pushes the lid plate into the inner part of the hood, the male terminals pass through the terminal-through holes in the lid plate, and the male terminals are connected to the mating terminals. At this time, since the terminal-through holes are closed by the resilient tongue pieces or deformable fibers, the male terminals can pass readily through the holes.

According to the connector of the present invention, since when the mating connector is not inserted into the hood, the male terminals are covered by the lid plate at the open end of the hood, it is possible to prevent the fingers or extraneous substances from entering into the interior of the hood through the holes and since the holes are closed by the tongue pieces or the fibers, fine substances such as dusts can not enter into the interior of the hood through the holes.

DETAILED DESCRIPTION OF THE PREFERRED EMBODIMENTS

Figure 1:
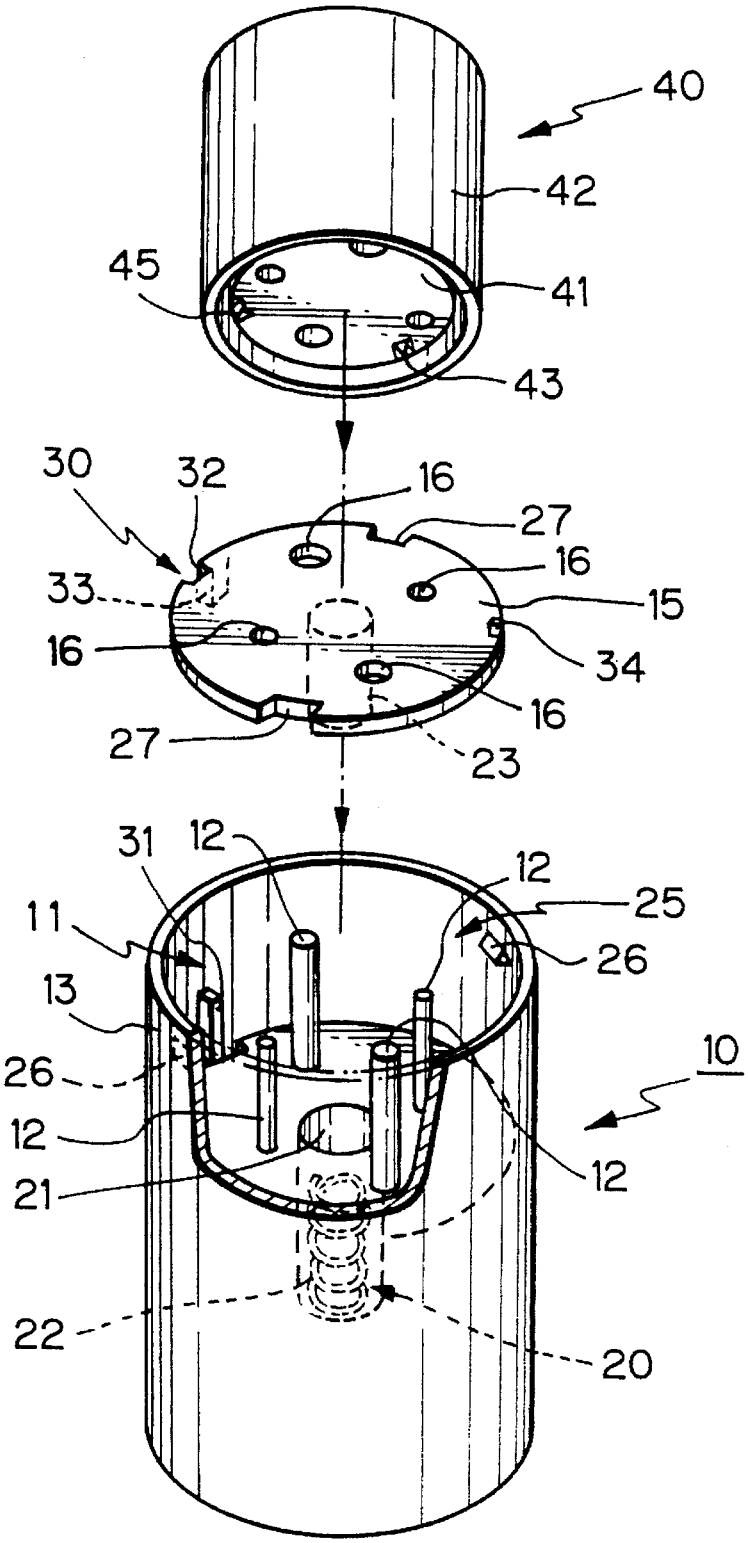
FIG. 1 is an exploded perspective view of a first embodiment of a connector of the present invention.

First through five embodiments of a connector of the present invention will be explained below by referring to FIGS. 1 through 21.

FIRST EMBODIMENT

A first embodiment of a connector of the present invention will be described below.

A connector 10 comprises: a connector body 11 having a plurality of male terminals 12 which stand parallelly on a circular end face thereof; a cylindrical hood 13 surrounding the male terminals 12; a circular lid plate 15 disposed in the interior of the hood 13 so that the plate 15 can move in parallel with the male terminals 12; means 20 for biasing the lid plate 15 to an open end of the hood 13; means 25 for constraining the lid plate 15 from falling off the hood 13; and means 30 for positioning the lid plate 15 at a given position in a circumferential direction in the hood 13.

<LID PLATE 15>

First, the lid plate 15 is described. The lid plate 15 has an outer diameter suitable for inserting into the hood 13 with a little clearance therebetween. The lid plate 15 is provided with terminal-through holes 16 through which the male terminal 12 passes freely.

<BIASING MEANS 20>

The biasing means 20 includes a compression coil spring 22 which is accommodated in a hole 21 in the center of an end face of the connector body 11 and a spring pusher 23 projected from an inner face of the lid plate 15. When the lid plate 15 is received in the hood 13, the spring pusher 23 is inserted into the hole 21 to compress the spring 22. The lid plate 15 is biased to an open end of the hood 13 by an elastic force exerted in the spring 22.

<CONSTRAINING MEANS 25>

The hood 13 is provided on the inner periphery adjacent to the open end with two limit projections 26. The lid plate 15 is provide on a peripheral edge with two recesses 27 corresponding to the limit projections 26. The lid plate 15 can enter into an inner part of the hood 13 when the recesses 27 are fitted to the projections 26 and the lid plate 15 is turned relatively to the hood 13 so that the recesses are shifted from the projections 26.

The lid plate 15 received in the hood 13 is constrained from coming out of the hood 13 by engaging the outer peripheral edge with the limit projections 26 at a protection position near the open end of the hood 13 with the male terminals 12 passing through the terminal-through holes 16.

<POSITIONING MEANS 30>

The hood 13 is provided on the inner periphery with an elongated stop projection 31 extending in parallel to the male terminals 12 and shifted from the limit projections 26. The stop projection 31 is disposed at a position lower than the limit projections in the hood 13. A length of the stop projection 31 is longer than that of the male terminal 12 and there is a space with a distance equal to a thickness of the lid plate 15 between the limit projections 26 and a top end of the projection 31.

On the other hand, the lid plate 15 is provided on a peripheral edge with a recess 32 corresponding to the stop projection 31 of the hood 13. The recess 32 is arranged in the lid plate 15 so that the recess 32 is shifted from the stop projection 31 when the recesses 27 in the lid plate 15 are fitted to the limit projections 26 of the hood 13. The lid plate 15 is also provided on the peripheral edge with an inner side stop projection 33 projecting downwardly adjacent to the recess 32 and with an outer side stop projection 34 projecting outwardly and shifted circumferentially from the projection 33.

When the lid plate 15 is disposed at a protection position between the limit projections 26 and the stop projection 31 in a longitudinal direction of the male terminal 12 and the recess 32 is fitted to the stop projection 31, the inner and outer side stop projections 33 and 34 engage with the stop projection 31 and one of the limit projection 26, thereby constraining the lid plate 15 from rotating circumferentially with respect to the hood 13.

<FEMALE CONNECTOR 40>

The female connector 40 is electrically coupled to the connector 10 constructed above. The female connector 40 includes a circular female connector body 41 having an outer diameter enough to be closely fitted in the hood 13 and a female connector hood 42 adapted to be enclosed by the hood 13. The connector body 41 is provided with female terminals to be connected to the male terminals 12. The connector body 41 is also provided on its outer periphery with two escape grooves 43 to be fitted to the two limit projections 26 and with a stop groove 45 to be fitted to the stop projection 31. The connector body 41 is provided on the top end with an escape recess (not shown) to be fitted to the outer side stop projection on the lid plate 15.

Figure 2A:
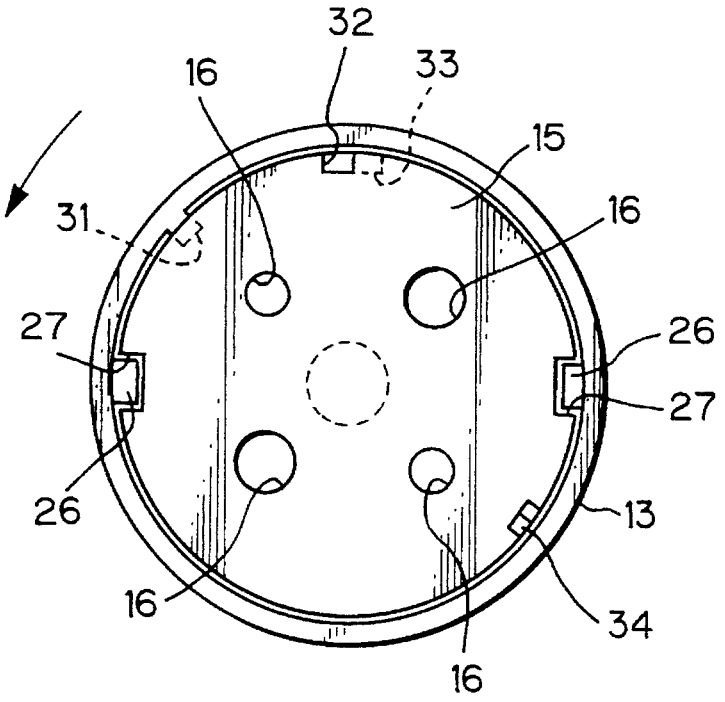
FIGS. 2A and 2B are enlarged plan view of a lid plate, illustrating processes of attaching the lid plate to the connector.

Upon assembling the connector 10 constructed above, the compression col spring 22 is accommodated in the spring-accommodating hole 21 of the connector body 11, the lid plate 15 is pushed into the hood 13 while elastically compressing the coil spring 22 by the spring pusher 23, as shown in FIG. 2A, with the opposite notches 27 being aligned with the stop projection 26 of the hood 13, and the inner edge of the lid plate 15 abuts on the limit projection 31.

Figure 2B:
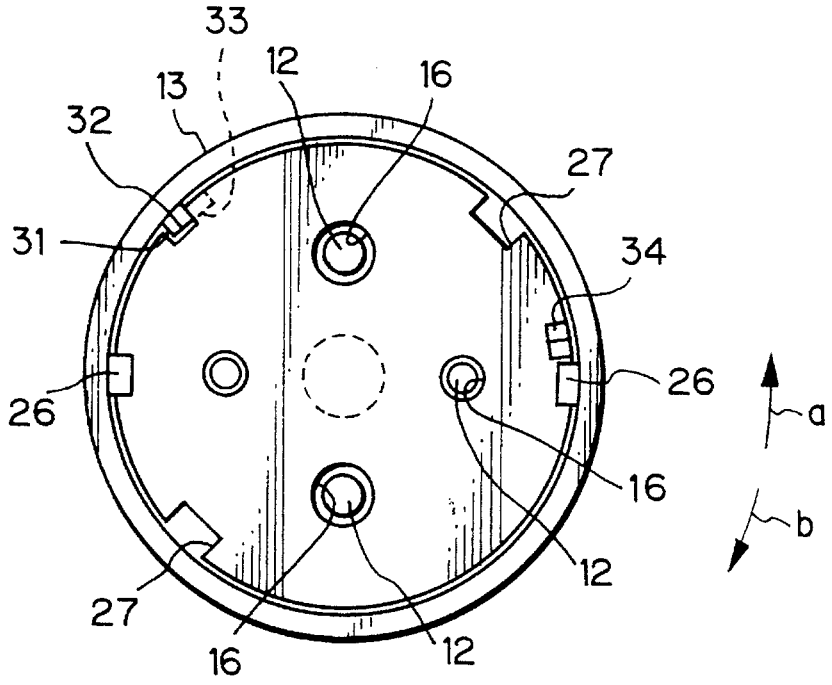
Figure 3:
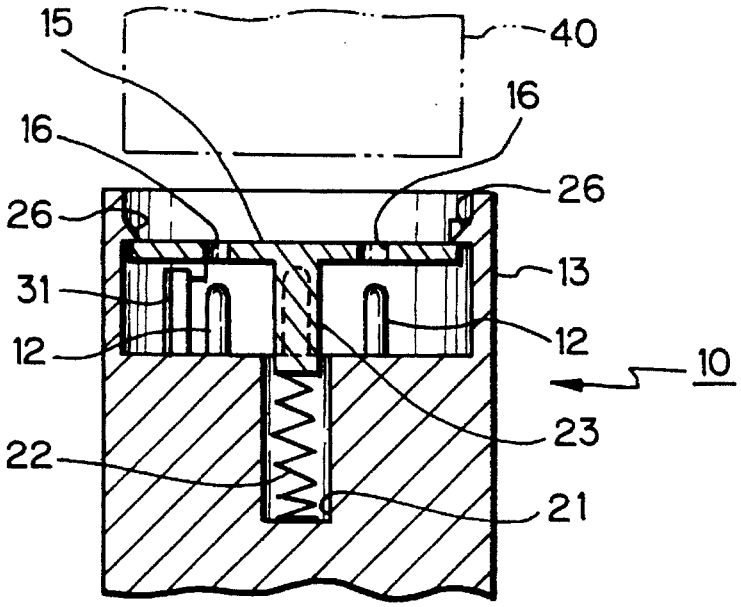
FIG. 3 is a fragmentary longitudinal sectional view of the connector upon detaching the connector.
Figure 4:
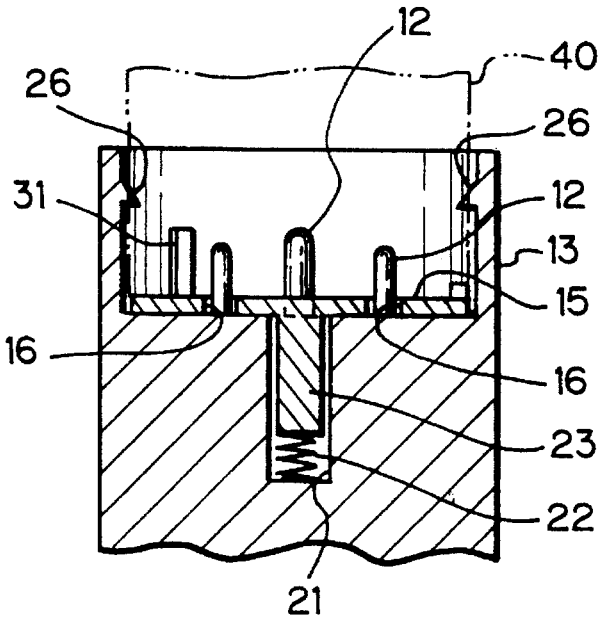
FIG. 4 is a fragmentary longitudinal sectional view of the connector upon coupling the connector.

Then, the recess 32 is aligned with the limit projection 31 of the hood 13 by rotating the lid plate 15 in the anticlockwise direction as shown by an arrow in FIG. 2B. The inner stop projection 33 of the lid plate 15 abuts on the side face of the limit projection 33. The outer stop projection 34 passes over one of the stop projections 26 and abuts on the side face of the stop projection 26, as shown in FIG. 2B.

The lid plate 15 is constrained from being displaced out of the hood 13 in the protection position covering the male terminals 12 from the open end of the hood 13. If a force is applied to the lid plate 15 in a direction shown by an arrow a in FIG. 2B, the inner stop projection 33 of the lid plate 15 abuts on the limit projection 31 of the hood 13 to be constrained from rotating. Reversely, if a force is applied to the lid plate 15 in a direction shown by an arrow b in FIG. 2B, the Surer stop projection 34 abuts on the stop projection 26 to be constrained from rotating. Accordingly, the lid plate 15 is prevented from rotating with the terminal-through hole 16 being aligned with the male terminal 12.

Since the lid plate 15 covers the male terminal 12 so as not to expose them in the connector 10, there is danger of the male terminals 12 being accidentally touched or of extraneous substances becoming attached to the male terminals 12.

Even if the lid plate 15 is pushed into the hood 13 by an external force under this state, the lid plate 15 will return to the original protection position by means of an elastic force of the spring 22 after removing the external force, thereby covering the male terminals 12.

In order to connect the female connector 40 to the connecter 10 under this position, the female connector 40 may be merely inserted into the hood 13 with the grooves 43 and 45 being positioned opposite to the projections 34 and 26. Then, the female connector 40 advances in the hood 13 while the connector 40 compresses the compression coil spring 22 and pushes the lid plate 15 into the inner part of the hood 13. Finally, the female connector 40 reaches the coupling position shown in FIG. 4 to electrically interconnect the connectors. The lid plate 15 in the protection position is constrained from rotating and falling off by the stop projections 33 and 34 and the limit projections 31 and 26. Accordingly, even if the male terminals 12 extend completely through the terminal-through holes 16 in the lid plate 15 and then reenter them, the male terminals 12 can completely pass through them and the lid plate 15 is pushed into the inner part of the hood 13.

Upon removing the connector 40 from the hood 13, the connector 40 is pulled out of the hood 13. When the female connector is drawn out, the male terminals 12 are drawn out of the female terminals and the lid plate 15 moves to the open end of the hood 13 by the spring 22 while contacting with the end of the female connector 40. After the male terminals 12 come out of the holes 16 completely, the lid plate 15 abuts on the limit projections 26 and maintains the protection position.

According to this embodiment, it is possible to connect and detach the female connector 40 to and from the hood 13 by a simple operation in which the female connector 40 is held and inserted into and drawn out of the hood 13 by one hand. In addition, since the male terminals are not exposed in the hood, electrical safety can be enhanced.

SECOND EMBODIMENT

A second embodiment will be explained below by referring to FIGS. 5 to 7.

Figure 5:
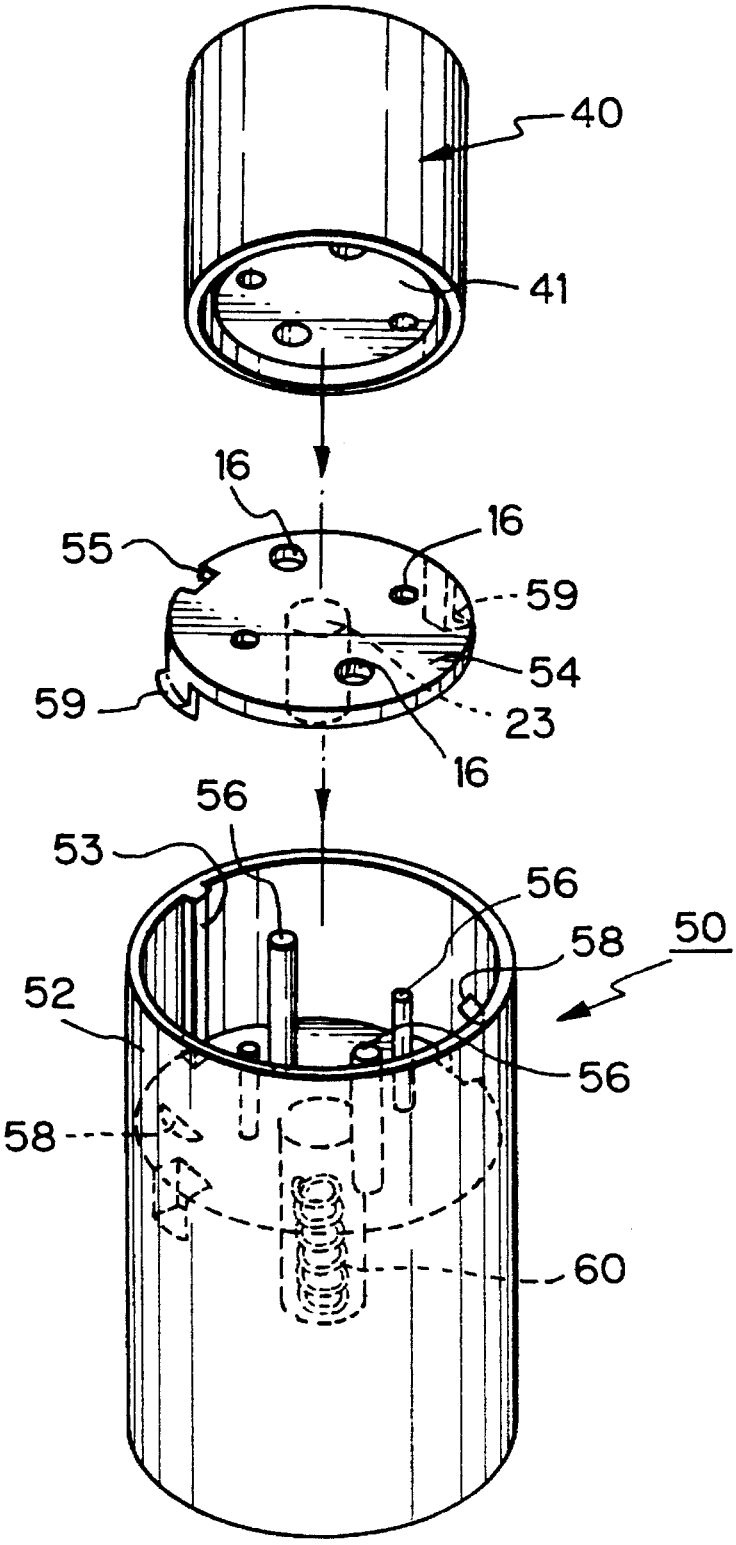
FIG. 5 is an exploded perspective view of a second embodiment of a connector of the present invention.

As shown in FIG. 5, a positioning means in the second embodiment of a connector 50 of the present invention includes a stop projection 53 provided on an inner periphery of a hood 52 and a recess 55 formed on a peripheral edge of a lid plate 54. The stop projection 53 extends from a bottom of the interior of the hood 52 to an open end of the hood 52.

The recess 55 engages with the stop projection 53 to constrain the lid plate 54 from rotating in the hood 52 when the lid plate 54 is disposed at the protection position on the open end side above distal ends of male terminals 56 and at a lower position below the protection position.

Figure 6:
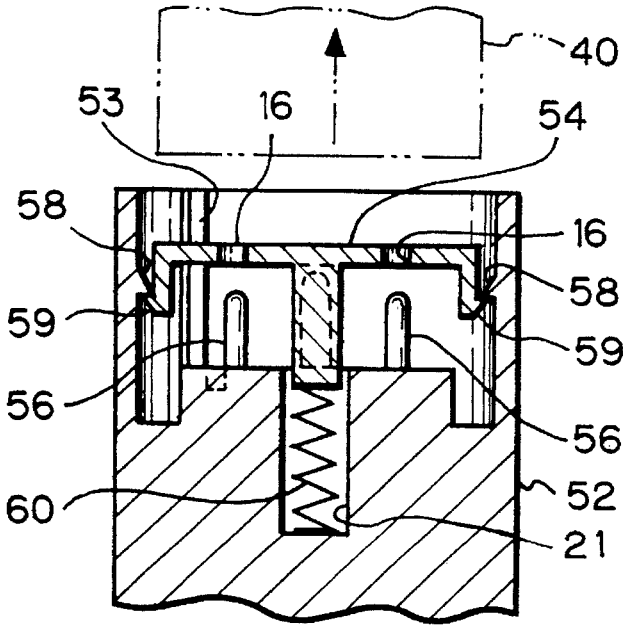
FIG. 6 is a fragmentary longitudinal sectional view of the connector upon detaching the connector.
Figure 7:
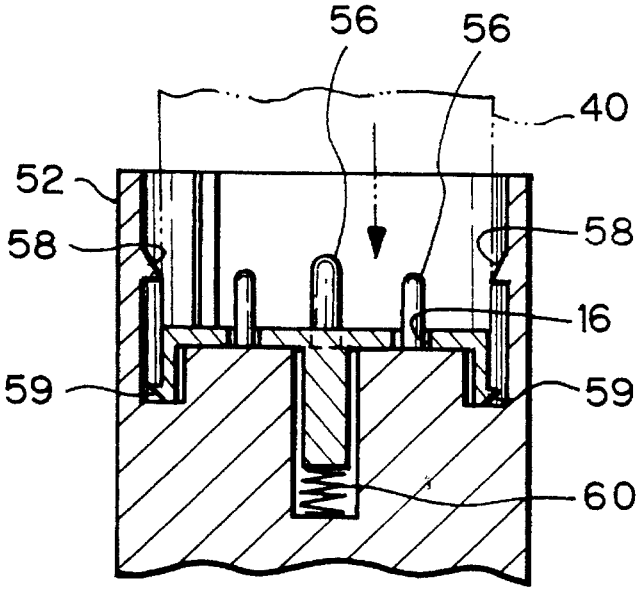
FIG. 7 is a fragmentary longitudinal sectional view of the connector upon coupling the connector.

As shown in FIGS. 5 and 6, a constraining means includes two limit projections 58 provided on the inner periphery of the hood 52 and two resilient locking fingers 59 formed on the peripheral edge of the lid plate 54. The resilient locking fingers 59 are aligned with the limit projections 58 when the recess 55 engages with said stop projections 53.

Upon assembling the connector 50 in the second embodiment, as shown in FIG. 6, the lid plate 54 is pushed into the hood 52 against the elastic force exerted in the spring 60 (biasing means) while the spring pusher 23 is compressing the spring 60, with the recess 55 being fitted to the stop projection 53. At this time, the slanted face of the resilient locking finger 59 rides and slides on the slanted face of the limit projection 58 so that the finger 59 is elastically deflected inwardly and moves to an inner part of the hood 52 more than the limit projections 58. Thereafter, when the lid plate 54 is released from the pushing force, the lid plate 54 is constrained from falling off the hood 52 since the resilient locking finger 59 engages with the limit projection 58 by the elastic force of the spring 60 (FIG. 6). Since the other constructions of the second embodiment are the same as those of the first embodiment, a detail explanation of them is omitted by giving the same reference numbers to the same parts. FIG. 7 shows a coupling position of the connectors 40 and 50.

It is also possible in this embodiment to effect the coupling and detaching of the female connector 40 by one hand. Since the male terminal 56 is covered by the lid plate 54 when the female connector 40 is removed, electrical safety can be enhanced.

THIRD EMBODIMENT

Figure 9:
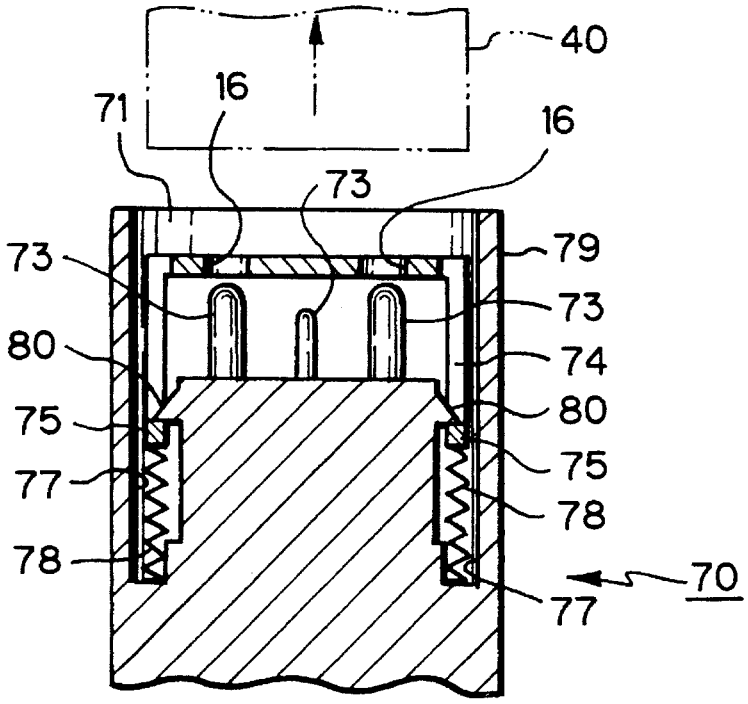
FIG. 9 is a fragmentary longitudinal sectional view of the connector upon detaching the connector.
Figure 10:
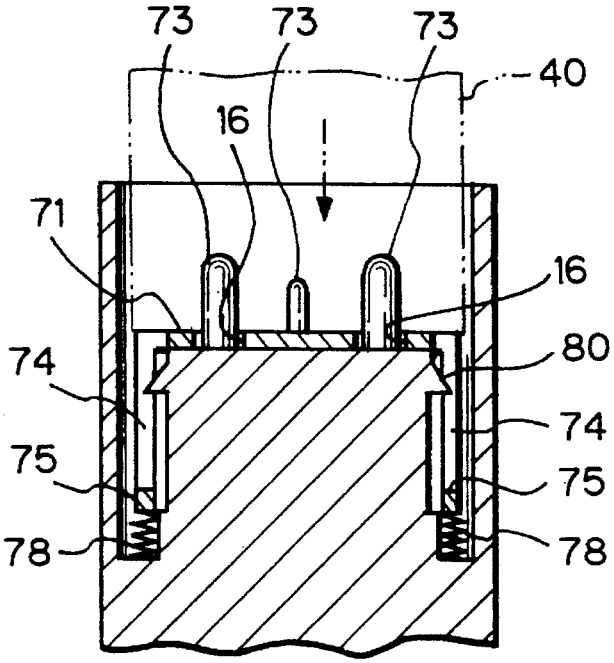
FIG. 10 is a fragmentary longitudinal sectional view of the connector upon coupling the connector.

A third embodiment of the connector will be explained below by referring to FIGS. 8 to 10.

Figure 8:
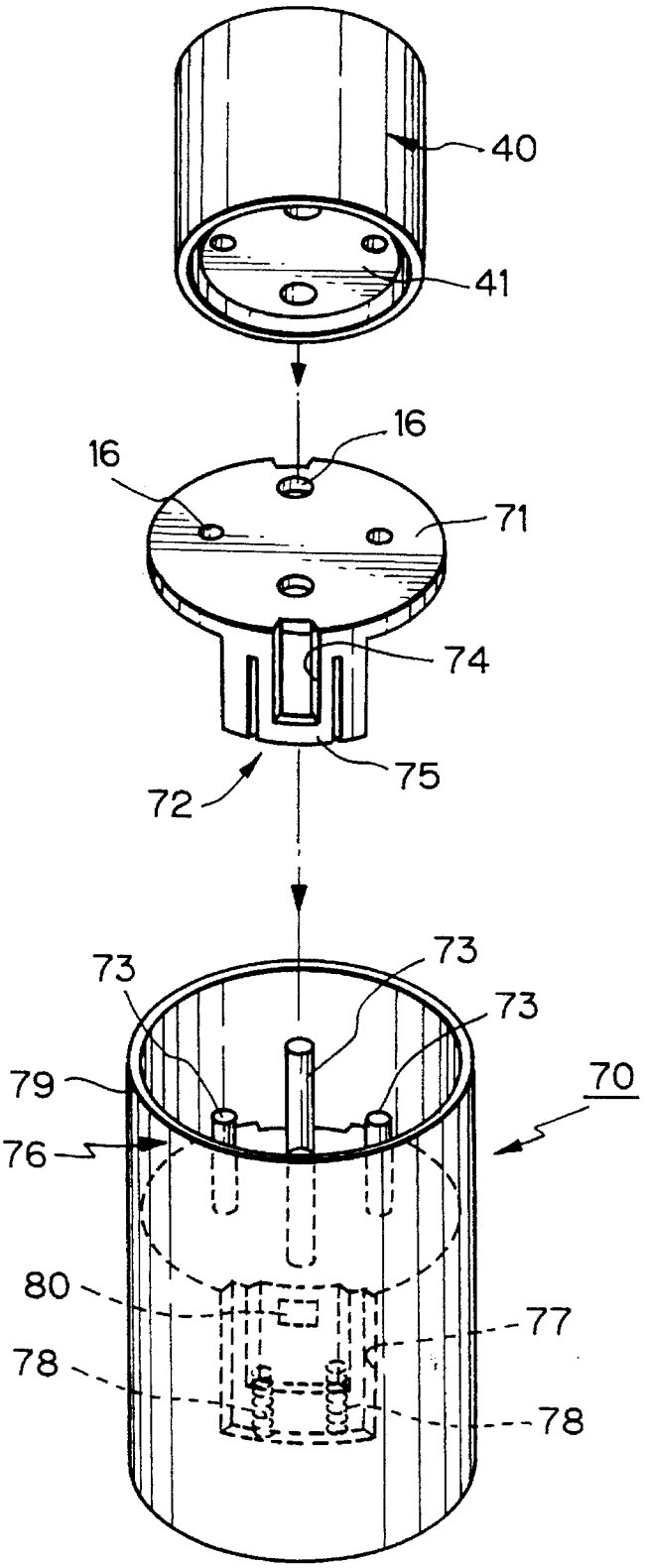
FIG. 8 is an exploded perspective view of a third embodiment of a connector of the present invention.

As shown in FIG. 8, a lid plate 71 of a third embodiment of a connector 70 is provided on a peripheral edge with two resilient locking fingers 72 having an arcuate cross section and extending inwardly. The resilient locking finger 72 is provided on the outer face with a groove 74 extending in parallel with male terminals 73. The groove 74 has a stop shoulder 75 at its end.

On the other hand, a connector body 76 of the connector 70 is provided with an arcuated groove 77 for receiving the resilient locking fingers 72 of the lid plate 71. A compression coil spring 78 constituting the biasing means is accommodated in the arcuated groove 77 in the connector body 76. The compression coil spring 78 pushes up the distal end of the resilient locking fingers 72 so that the lid plate 71 is biased to the protection position in the hood 79.

A limit projection 80 is provided on the inner periphery of the arcuated groove 74. The limit projection 80 engages with the groove 74 in the resilient locking finger 72 to permit the lid plate 71 not to rotate circumferentially in the hood 79 but to move in the direction parallel to the male terminals 73. The limit projection 80 constrains the lid plate 71 from falling off the hood 79 when the stop shoulder 75 on the groove 74 in the resilient locking finger 72 abuts on the limit projection 80 (FIG. 9). That is, the resilient locking fingers 72 and limit projections 80 constitute the positioning means and constraining means. When the lid plate 71 is pushed into the hood 79, the resilient locking finger 72 clears the limit projection 80 while being elastically deformed outwardly and enters into the groove 77 (FIG. 9). Since the other constructions of the third embodiment are the same as those of the first embodiment, a detailed explanation of them is omitted and the same reference numbers denote the same parts. FIG. 10 shows a coupling position of the connectors 40 and 70.

It is also possible in this embodiment to effect the coupling and detaching of the female connector 40 by one hand. Since the male terminals 73 is covered by the lid plate 71 when the female connector 40 is removed, electrical safety can be enhanced.

FOURTH EMBODIMENT

A fourth embodiment of the connector of the present invention will be explained below by referring to FIGS. 11 to 13.

Figure 11:
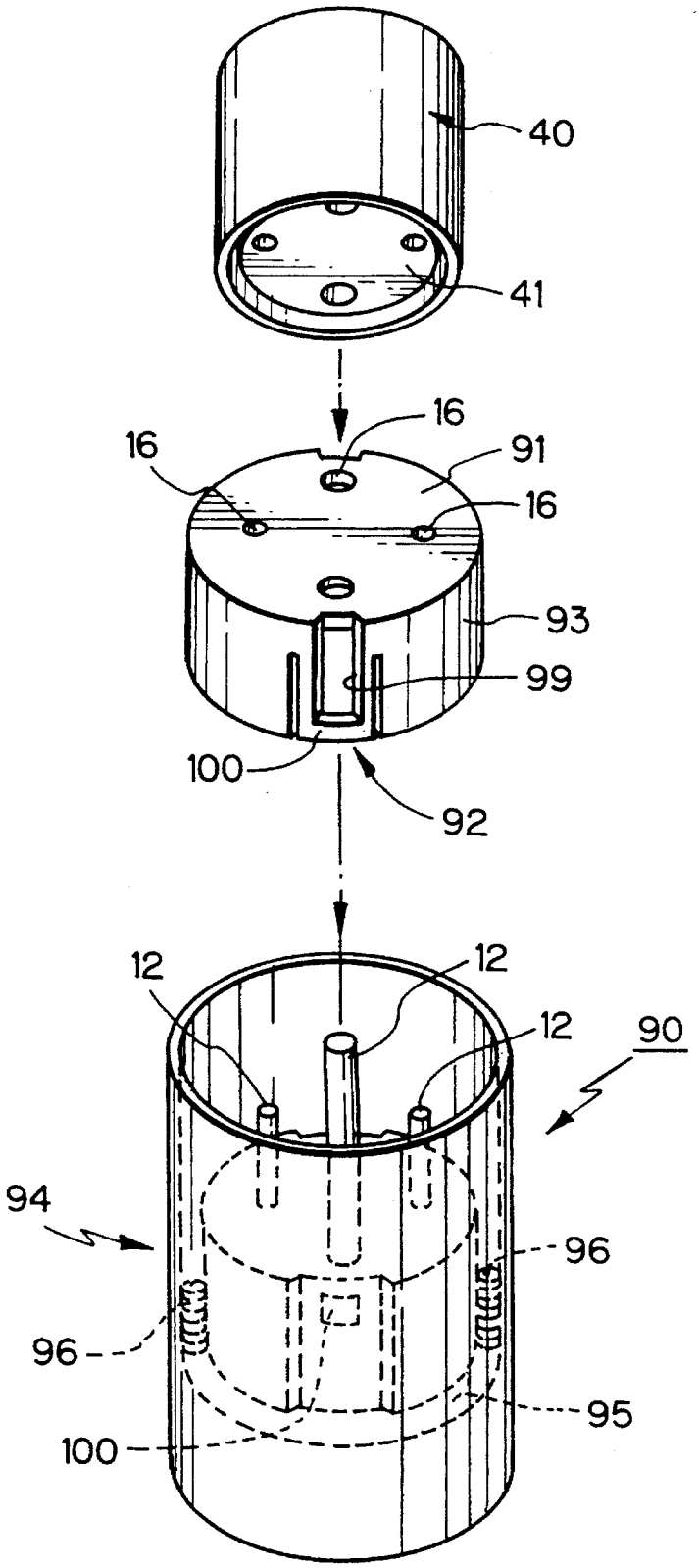
FIG. 11 is an exploded perspective view of a fourth embodiment of a connector of the present invention.

As shown in FIG. 11, in a fourth embodiment of a connector 90 of the present embodiment, a lid plate 91 is provided with a cylindrical wall 93 extending downwardly. A resilient locking finger 92 is formed in the cylindrical wall 93. A connector body 94 of the connector 90 is provided on the entire periphery with an annular groove 95.

A plurality of compression coil springs 96 constituting the biasing means are accommodated in the annular groove 95. The compression coil spring 96 pushes up the distal end of the cylindrical wall 93 to bias the lid plate 91 to the protection position (FIG. 12).

Figure 12:
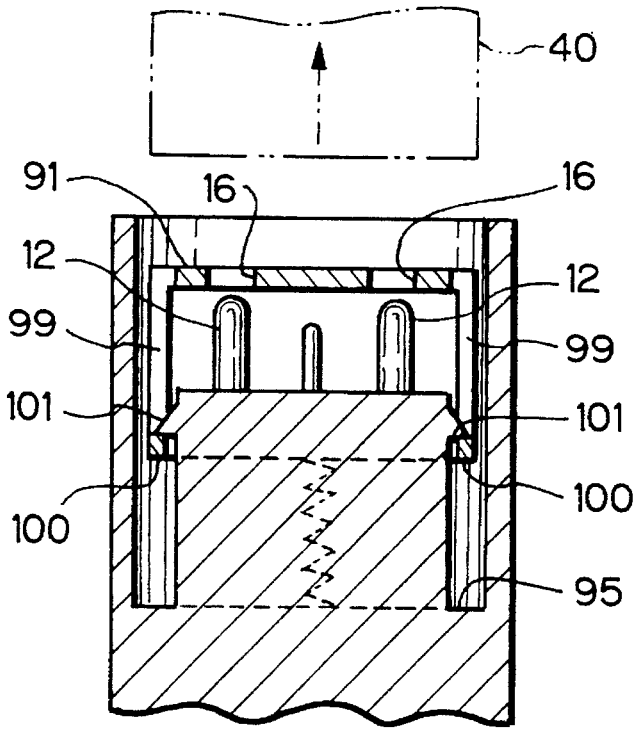
FIG. 12 is a fragmentary longitudinal sectional view of the connector upon detaching the connector.
Figure 13:
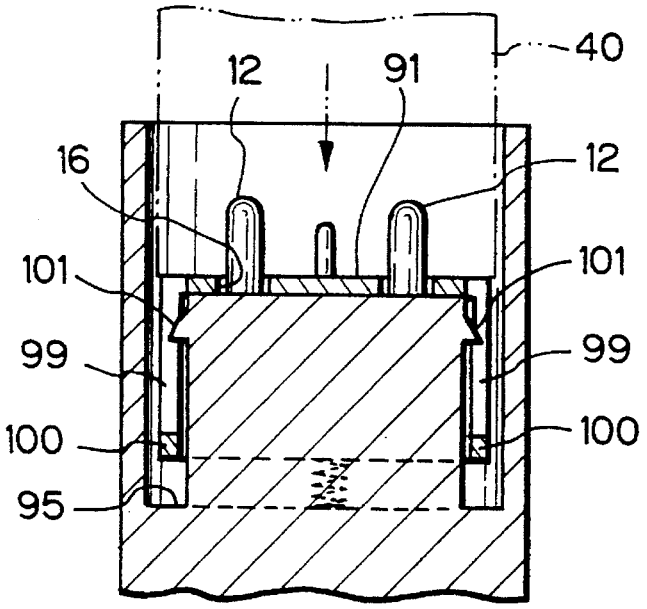
FIG. 13 is a fragmentary longitudinal sectional view of the connector upon coupling the connector.
Figure 14:
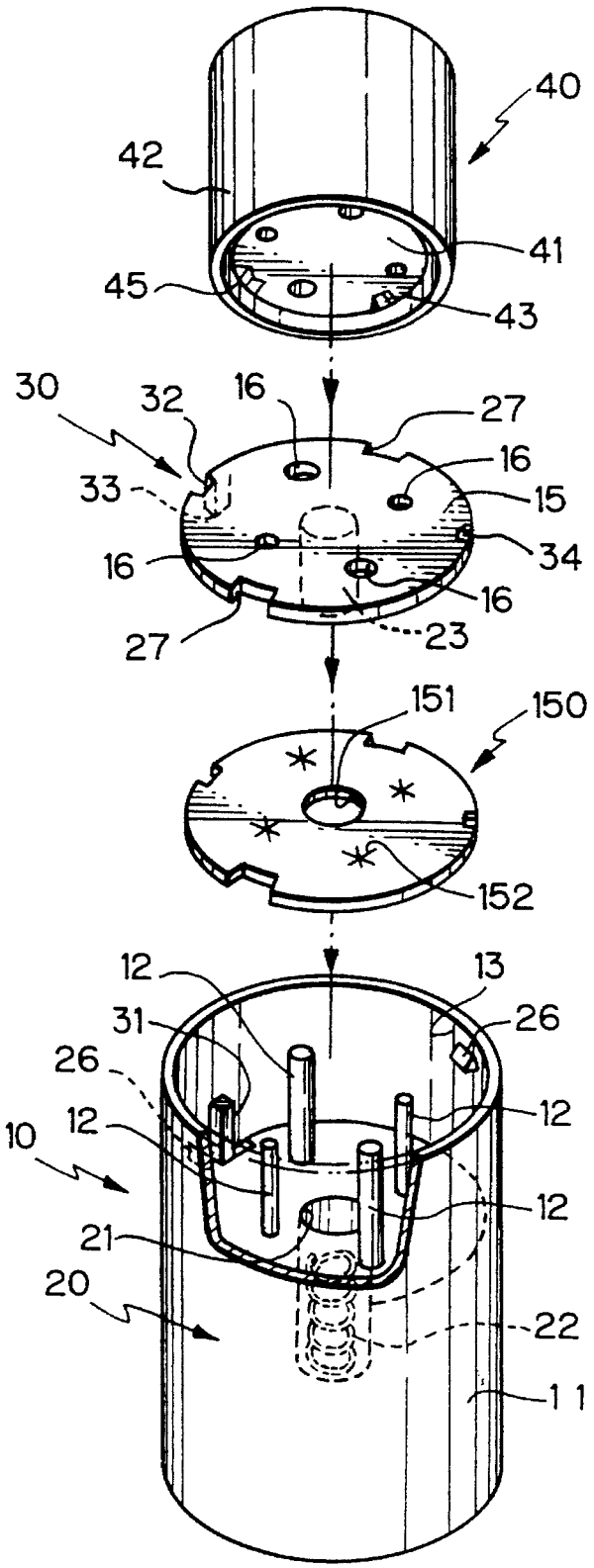
FIG. 14 is an exploded perspective view of a fifth embodiment of a connector of the present invention.

Also, the positioning means and constraining means comprise a groove 92 in a resilient locking finger 92, a stop shoulder 100, and a limit projection in an annular groove 95 in the same manner as those of the third embodiment (FIG. 12). Since the other constructions are the same as those of the first embodiment, a detailed explanation of them is omitted by giving the same signs to the elements and parts. FIG. 13 shows the connectors 40 and 90 connected with each other.

In this embodiment, the female connector 40 can be easily coupled to and detached from the connector in a single-handed operation. When the female connector 40 is detached, the male terminals 12 are covered by the lid plate 91, thereby enhancing electrical safety.

It should be noted that the present invention is not limited to the first through fourth embodiments described above by referring to the drawings and the present invention can include the following alternations:

(1) Although the compression coil spring is utilized as the biasing means in the above embodiments, another means for biasing the lid plate to the protection position may be provided in which the hood is open at a lower end and a weight of the lid plate is set more than a given value in consideration of a friction between the hood and the lid plate.

(2) The biasing means utilizing an elastic force of the spring force of the spring may be ones utilizing a leaf spring instead of the compression coil spring.

(3) The positioning means for preventing the rotation of the lid plate may be a hood and a lid plate which have a non-circular cross section such as rectangular or polygonal cross section.

FIFTH EMBODIMENT

A fifth embodiment of a connector of the present invention will be explained below by referring to FIGS. 14 to 21.

This embodiment has the same basic construction as that of the first embodiment. Accordingly, different construction and operation between them are explained below. A detail explanation is omitted by giving the same signs to the same elements and parts.

Figure 18:
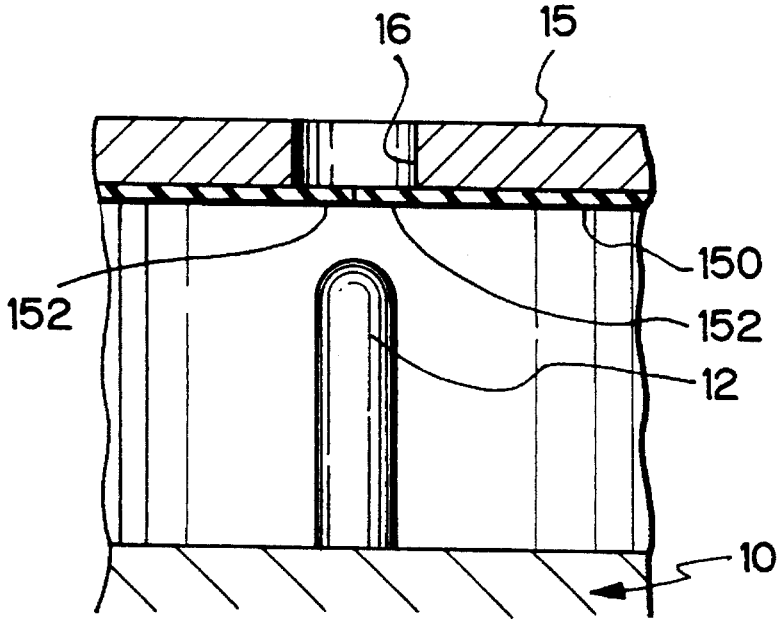
FIG. 18 is a fragmentary longitudinal sectional view of the connector upon detaching the connector.

A connector of the fifth embodiment further comprises a flexible member such as a dust-proofing rubber plate 150 attached to the rear side of the lid plate 15 for deformably covering the terminal-through hole 16. The dust-proofing rubber plate 150 made of a thin rubber sheet is attached to a rear side (lower side in the drawing) of the lid plate 15 by, for example, an adhesive. The dust-proofing rubber plate 150 has the same outer peripheral shape of the lid plate 15 and is provided at the center with an escape hole 151 for permitting the spring pusher 23 of the lid plate 15 to be passed through it. The rubber plate 150 is provided with a plurality of tongue pieces 152 at the positions corresponding to the terminal-through holes 16. The tongue pieces 152 have many triangular pieces formed by slits extending radially from the center of the hole 16 to the peripheral edge. The tongue pieces 152 normally extend in a straight manner to close the holes 16, as shown in FIG. 18.

Figure 15A:
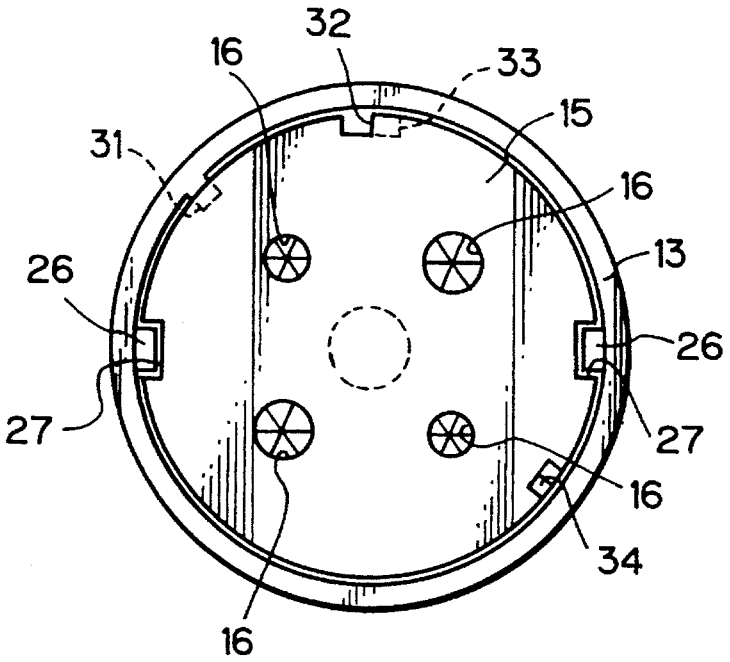
FIGS. 15A and 15B are enlarged plan views of a lid plate, illustrating processes of attaching the lid plate to the connector.

Upon assembling the connector 10 constructed above, the compression coil spring 22 is accommodated in the spring-accommodating hole 21 of the connector body 11, the lid plate 15 having the dust-proofing rubber plate 150 is pushed into the hood 13 while elastically compressing the coil spring 22 by the spring-pressing portion 23, as shown in FIG. 15A, with the opposite notches 27 being aligned with the stop projection 26 of the hood 13, and the inner edge of the lid plate 15 abuts on the limit projection 31.

Figure 15B:
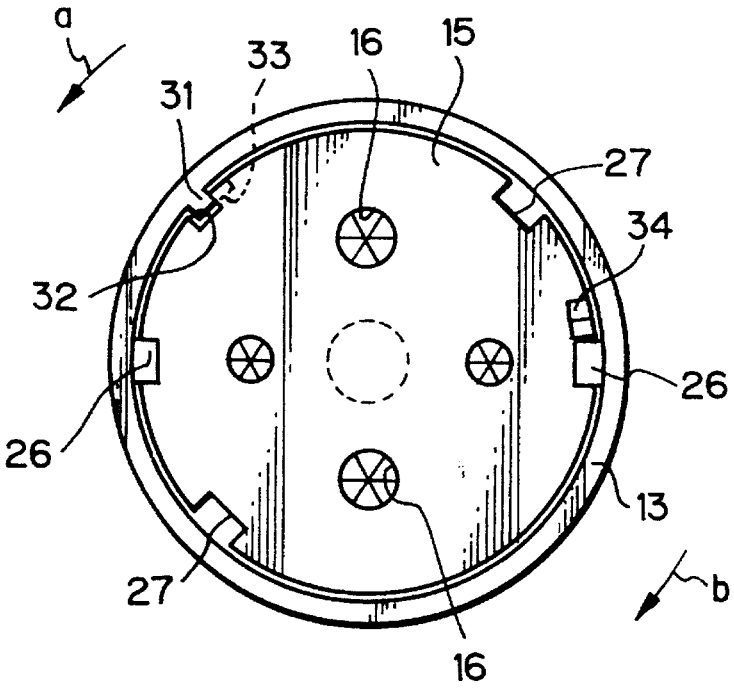

Then, the recess 32 is fitted to the limit projection 31 of the hood 13 by rotating the lid plate 15 in the anticlockwise direction as shown by an arrow in FIG. 15B. The inner stop projection 33 of the lid plate 15 abuts on the side face of the limit projection 33. The outer stop projection 34 passes over one of the stop projections 26 and abuts on the side face of the stop projection 26, as shown in FIG. 2B.

The lid plate 15 is constrained from displacing out of the hood 13 in the projection position covering the male terminals 12 from the open end of the hood 13. If a force is applied to the lid plate 15 in a direction shown by an arrow a in FIG. 15B, the inner stop projection 33 of the lid plate 15 abuts on the limit projection 31 of the hood 13 to be constrained from rotating. Reversely, if a force is applied to the lid plate 15 in a direction shown by an arrow b in FIG. 15B, the outer stop projection 34 abuts on the stop projection 26 to be constrained from rotating. Accordingly, the lid plate 15 is prevented from rotating with the terminal-through hole 16 being fitted to the male terminal 12.

Figure 16:
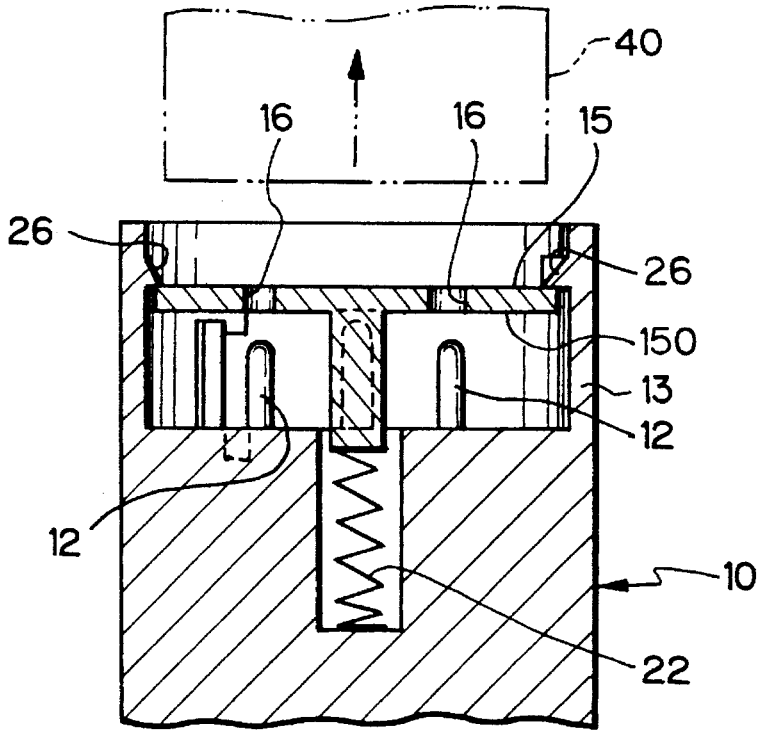
FIG. 16 is a fragmentary longitudinal sectional view of the connector upon detaching the connector.
Figure 17:
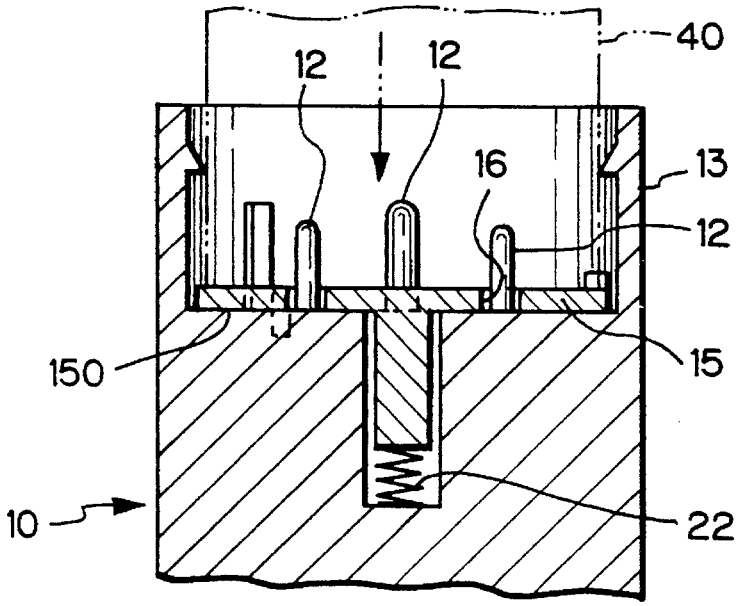
FIG. 17 is a fragmentary longitudinal sectional view of the connector upon coupling the connector.

Since the lid plate 15 covers the male terminal 12 so as not to expose them in the connector 10, as shown in FIGS. 16 and 17, there is no-danger of the male terminals 12 being accidentally touched or no problem of extraneous substances attached to the male terminals 12. Furthermore, since the terminal-through holes 16 are closed by the deformable tongue pieces 152 of the dust-proofing rubber plate 150, fine dusts or rain drops do not pass through the holes 16, thereby preventing electrical failure such as deterioration of an insulation function.

Even if the lid plate 15 is pushed into the hood 13 by an external force under this state, the lid plate 15 will return to the original protection position by means of an elastic force of the spring 22 after removing the external force, thereby covering the male terminals 12.

Figure 19:
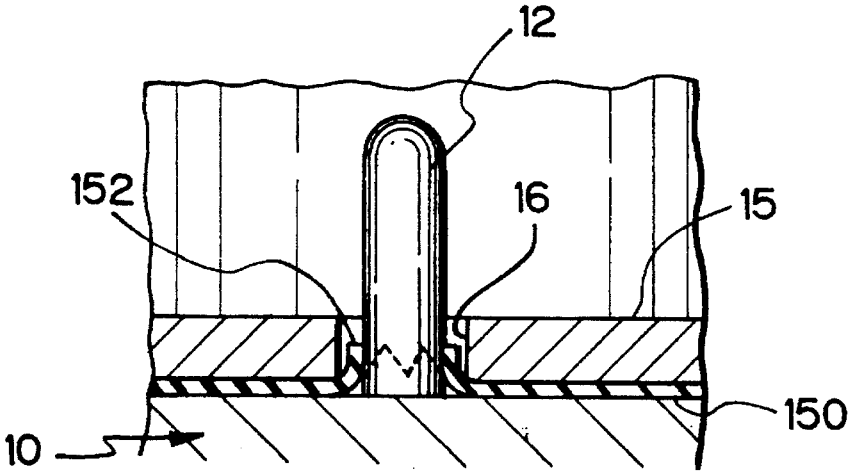
FIG. 19 is a fragmentary longitudinal sectional view of the connector upon coupling the connector.

In order to connect the female connector 40 to the connector 10 under this position, the female connector 40 may be merely inserted into the hood 13 in the manner described above. Then, the female connector 40 advances in the hood 13 while the connector 40 compresses the compression coil spring 22 and pushes the lid plate 15 into the inner part of the hood 13. Finally, the female connector 40 reaches the coupling position shown in FIG. 17 to electrically interconnect the connectors. The lid plate 15 in the protection position is constrained from rotating and failing off by the stop projections 33 and 34 and the limit projections 31 and 26. Accordingly, even if the male terminals 12 extend completely through the terminal-through holes 16 in the lid plate 15 and then reenter them, the male terminals 12 can completely pass through them and the lid plate 15 is pushed into the inner part of the hood 13. The tongue pieces 152 of the dust-proofing rubber plate 150 which close the terminal-through holes 16 are elastically deformed to open the holes as shown in FIG. 19, thereby readily passing the male terminals 12 through the pieces 152.

Upon removing the connector 40 from the hood 13, the connector 40 is pulled out of the hood 13. When the female connector is drawn out, the male terminals 12 are drawn out of the female terminals and the lid plate 15 moves to the open end of the hood 13 by the spring 22 while contacting with the end of the female connector 40. After the male terminals 12 come out of the holes 16 completely, the tongue pieces 152 of the dust-proofing rubber plate 150 return to the original position by their elasticity to close the terminal-through holes 16 as shown in FIG. 18 and the lid plate 15 abuts on the limit projections 26 and maintains the protection position.

According to this embodiment, it is possible to connect and detach the female connector 40 to and from the hood 13 by a simple operation in which the female connector 40 is held and inserted into and drawn out of the hood 13 by one hand. In addition, since the male terminals are not exposed in the hood, electrical safety can be enhanced. Since the terminal-through holes 16 are always closed by the tongue pieces 152 of the dust-proofing rubber plate 150, it is possible to positively prevent dust, rain, or the like from entering through the terminal-through holes 16 into the hood 13.

Figure 20:
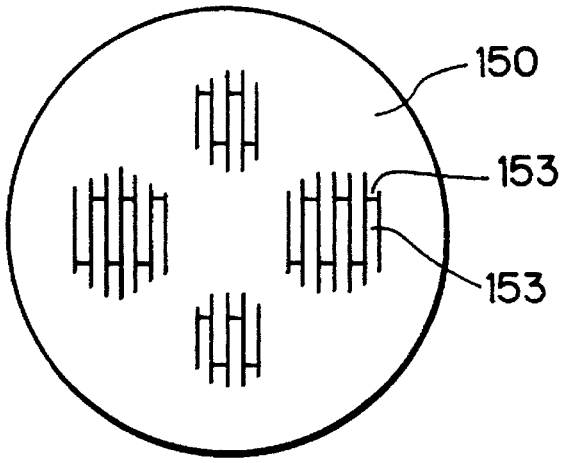
FIG. 20 is a plan view of a dust-proofing rubber plate, illustrating an alternative example of tongue pieces of the rubber plate.

It should be noted that the present invention is not limited to the fifth embodiment described above by referring to the drawings and the present invention can include the following alternations:

(1) Although the tongue pieces 152 of the dust-proofing rubber plate 150 are formed into a triangular shape in the fifth embodiment, they may be formed into narrow long and short tablets 153 as shown in FIG. 20.

Figure 21:
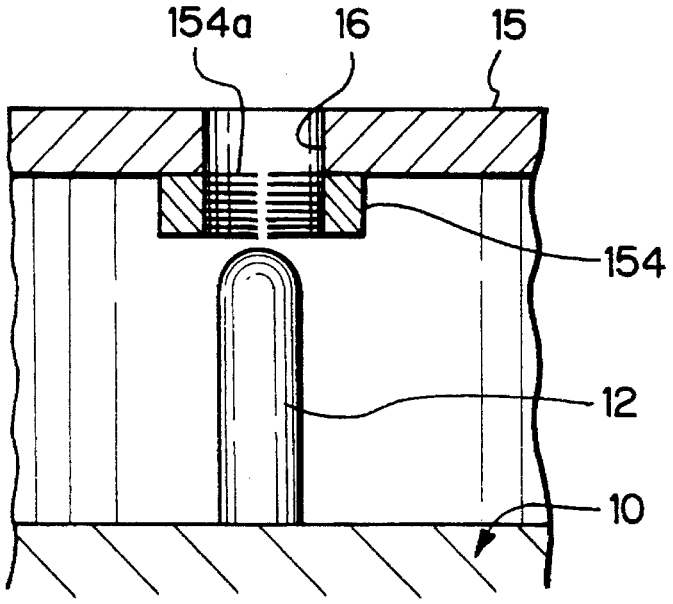
FIG. 21 is a fragmentary enlarged longitudinal sectional view of an embodiment of a closing member which closes a terminal-through hole by fiber materials.

(2) It is not necessary to provide the tongue pieces 152 or 153 in order to close the terminal-through holes 16 in the lid plate. For example, as shown in FIG. 21, it may be possible to provide a tube planted with many fibers 154*a* in the interior around the terminal-through holes 16 in the lid plate 15. These fibers act as a partial seal to minimize the chance of dust contaminating the terminals.

(3) The dust-proofing rubber plate 150 may be applied to the first through fourth embodiments.

We claim:

1. A connector wherein a plurality of male terminals is provided on the interior of a hood adapted to receive a female connector having a plurality of female terminals comprising:

a lid plate provided with a plurality of terminal through-holes through each of which one of said male terminals can pass, said lid plate received in said hood movably in the inserting and detaching directions;

said lid plate being biased toward a protection position in which said lid plate covers an open end of said hood;

said lid plate being restrained from falling off said hood;

a positioning device for locating said lid plate when it is at said protection position in the hood so that said terminal through-holes face said male terminals;

said lid plate having, on a peripheral edge, two resilient locking fingers each with an arcuate cross section and extending inwardly, each said resilient locking finger being provided on its outer face with a groove extending parallel to said male terminals, said groove having a stop shoulder at its end, a connector body of said connector having an arcuate groove for receiving said resilient locking fingers, a compression coil spring in said arcuate groove in said connector body, said compression coil spring biases the distal end of said resilient locking fingers so that said lid plate is biased toward said protection position, a limit projection on the inner periphery of said arcuate groove, said limit projection engaging said groove in said resilient locking finger to prevent said lid plate from rotating in said hood and permit said lid plate to move in a direction parallel to said male terminals, said limit projection preventing said lid plate from falling off said hood when said stop shoulder abuts said limit projection.

2. A connector according to claim 1 further comprising a flexible member attached to the rear side of said lid plate for deformably covering said terminal through-hole.

3. A connector according to claim 2, wherein said flexible member is a dust-proof rubber plate having a plurality of tongue pieces at each position confronting said terminal-through holes.

4. A connector according to claim 2, wherein said flexible member is a dust-proof rubber having a plurality of fiber materials at each position confronting said terminal-through holes.

5. A connector according to claim 2, wherein said flexible member is a tube having a plurality of fiber materials in its interior.

6. A connector wherein a plurality of male terminals is provided on the interior of a hood adapted to receive a female connector having a plurality of female terminals comprising:

a lid plate provided with a plurality of terminal through-holes through each of which one of said male terminals can pass, said lid plate received in said hood movably in the inserting and detaching directions;

said lid plate being biased toward a protection position in which said lid plate covers an open end of said hood;

said lid plate being restrained from falling off said hood;

a positioning device for locating said lid plate when it is at said protection position in the hood so that said terminal through-holes face said male terminals;

said lid plate having a cylindrical wall extending downwardly, a resilient locking finger in said cylindrical wall, a connector body of said connector comprising an annular groove on its entire periphery, a plurality of compression coil springs in said annular groove, said compression coil springs pushing the distal end of said cylindrical wall up, thereby biasing said lid plate toward said protection position;

a limit projection on the inner periphery of said annular groove, said resilient locking finger having on its outer face, a groove extending parallel to said male terminals, said groove having a stop shoulder at its end;

said limit projection engaging a groove in said resilient locking finger to prevent said lid plate from rotating in said hood and causing it to move in a direction parallel to said male terminals, said limit projection preventing said lid plate from falling off said hood when said stop shoulder abuts said limit projection.

7. A connector according to claim 6, further comprising a flexible member attached to the rear side of said lid plate for deformably covering said terminal-through holes.

8. A connector according to claim 6, wherein said flexible member is a dust-proof rubber plate having a plurality of tongue pieces at each position confronting said terminal-through holes.

9. A connector according to claim 6, wherein said flexible member is a dust-proof rubber having a plurality of fiber materials at each position confronting said terminal-through holes.

10. A connector according to claim 6, wherein said flexible member is a tube having a plurality of fiber materials provided in its interior.

* * * * *